US010253565B2

(12) United States Patent
Cornthwaite

(10) Patent No.: US 10,253,565 B2
(45) Date of Patent: Apr. 9, 2019

(54) FOLDABLE STEP

(71) Applicant: TNICO Technology Division Ltd., Leduc (CA)

(72) Inventor: Don Cornthwaite, Red Deer (CA)

(73) Assignee: TNICO Technology Division Inc., Red Deer (CA)

( * ) Notice: Subject to any disclaimer, the term of this patent is extended or adjusted under 35 U.S.C. 154(b) by 0 days.

(21) Appl. No.: 15/780,440

(22) PCT Filed: Dec. 8, 2016

(86) PCT No.: PCT/CA2016/051443
§ 371 (c)(1),
(2) Date: May 31, 2018

(87) PCT Pub. No.: WO2017/096481
PCT Pub. Date: Jun. 15, 2017

(65) Prior Publication Data

US 2018/0363372 A1 Dec. 20, 2018

Related U.S. Application Data

(60) Provisional application No. 62/264,999, filed on Dec. 9, 2015.

(51) Int. Cl.

| | |
|---|---|
| ***E06C 1/34*** | (2006.01) |
| ***E06C 1/16*** | (2006.01) |
| ***A47B 97/00*** | (2006.01) |
| ***E06C 1/383*** | (2006.01) |
| ***E06C 1/00*** | (2006.01) |

(52) U.S. Cl.
CPC ..... *E06C 1/34* (2013.01); *A47B 97/00* (2013.01); *E06C 1/005* (2013.01); *E06C 1/16* (2013.01); *E06C 1/383* (2013.01); *A47B 2220/05* (2013.01)

(58) Field of Classification Search
CPC ... E06C 1/34; E06C 1/16; E06C 1/383; E06C 1/005; A47B 2220/05; A47B 97/00
See application file for complete search history.

(56) References Cited

U.S. PATENT DOCUMENTS 2,555,149 A * 5/1951 Mushta ..... E06C 1/005 182/163
2,581,488 A * 1/1952 Keltner ..... E06C 9/08 182/77
5,085,290 A * 2/1992 Guirlinger ..... E06C 1/005 182/77
5,819,670 A * 10/1998 O'Connor ..... A47B 5/06 108/48

(Continued)

*Primary Examiner* — Alvin C Chin-Shue
(74) *Attorney, Agent, or Firm* — McMillan LLP

(57) ABSTRACT

The present invention relates to at least a foldable step mounted within a cabinet or cupboard of varying heights and having a minimal folded profile. The foldable step has a pair of cross members secured in a horizontal orientation to the cupboard. The cross members are coupled to a pair of cupboard support members. The cupboard support members are rotatably coupled to two offset members that rotate vertical support members to reach the floor. The vertical support members hold a plurality of steps using other support members. The entire linkage structure pivotally or slidably folds into a minimal profile.

5 Claims, 3 Drawing Sheets

(56) References Cited

U.S. PATENT DOCUMENTS

| | | | | |
|---|---|---|---|---|
| 6,427,804 | B1 * | 8/2002 | Lazarus | A47C 7/008 182/153 |
| 9,883,741 | B2 * | 2/2018 | Demasi, III | A47B 46/005 |
| 2007/0018545 | A1 * | 1/2007 | Calabria | A47B 77/10 312/311 |
| 2010/0308615 | A1 * | 12/2010 | Miles | A47B 77/10 296/37.8 |
| 2015/0001005 | A1 * | 1/2015 | Goodson | E06C 1/005 182/96 |
| 2015/0033786 | A1 * | 2/2015 | Mansfield | F25D 23/12 62/449 |

* cited by examiner

FOLDABLE STEP

CROSS REFERENCES

This application claims priority from U.S. 62/264,999, the contents of which are incorporated herein by reference.

FIELD OF THE INVENTION

The present invention relates generally to a foldable step. More particularly, the present invention relates to at least a foldable step mounted within a cabinet or cupboard of varying heights and having a minimal folded profile.

BACKGROUND OF THE INVENTION

U.S. Patent Publication No. 2015/0001005 to Goodson discloses a folding step stool that is mounted and stored within a cabinet. When not in use, the entirety of the folding step stool may be disposed within an interior of the cabinet to permit closure of the cabinet door. When required, the cabinet door may be opened and the step stool may be deployed to provide one or more steps for use in accessing a counter or sink above the cabinet. If the cabinet is a non-standard height, Goodson requires the use of adjustable feet having a threaded screw on the lower end of each leg.

U.S. Pat. No. 5,697,470 to Carle describes a ladder assembly which can be slidably withdrawn from and deployed out of the integral housing, remaining slidably joined to said housing while said housing is fastened to an independent support structure, pivoted upon the integral hinge and axle pivot mechanisms, have the ladder legs contact the floor in an angular relationship, and provide at least one rigid and sturdy step or rung horizontally spanning the distance between said ladder legs a desired distance from the floor and essentially parallel thereto upon which a user can place one or both feet, stand, and thereby conveniently reach places or objects located above an elevation that could be reached while standing on the floor.

U.S. Pat. No. 5,131,492 to Caminiti teaches a collapsible folding step-stool which is mountable to a cabinet door. The step stool has a bracket mountable to the cabinet door; a platform movable between a lowered, generally horizontal, operative position and a raised, generally vertical, inoperative position; a plurality of parallel arms attached at their first ends to the platform and pivotally coupled at their second ends to the bracket; and a plurality of parallel support legs movable between a generally vertical operative position perpendicular to the platform and a generally vertical inoperative position parallel with the platform and the bracket. The support legs have upper ends pivotally coupled to the platform and lower ends which, when the platform is in the operative position, are adapted to rest on the floor with the lower ends of the legs at a lower elevation than the bottom of the bracket.

U.S. Pat. No. 3,136,386 to Horvath et al. describes a foldaway step mounted inside the door of a kitchen cabinet and arranged to be folded away flat against the inside of the door when not in use. The step is arranged to slide up and down on a plate attached to the inside of a cabinet door so that when moved upward it can be folded flat and locked in position inside the door and when moved downward and unfolded it comes into engagement with the floor below the door in whatever position to which the door has been opened and provides a solid step which does not provide any strain on the door itself when used as a step.

U.S. Pat. No. 3,030,166 to Richards et al. discloses a cabinet and stepladder which does not utilize the cabinet storage space when in the folded position. The stepladder has lower and upper steps pivotally moved on rods so that their adjacent edge portions move into interfitting engagement along a joint. The legs are pivotally connected to opposite sides of the steps adjacent the forward edges of the steps by pivot rods which are positioned within grooves in the forward edges of the steps. The rods are secured to the legs as to permit pivotal movement of the legs.

In the previously described foldable steps, they must be precisely installed or require adjustment of leg lengths after installation. Moreover, they do not automatically position themselves to have legs in full contact with the floor while maintaining horizontal steps. It is an object of this invention to at least provide a novel foldable step capable of automatically adjusting its height to different cabinet heights without requiring adjustment. The cupboard door does not provide any structural support to the foldable step. It only houses and stores the step hidden when not in use.

SUMMARY OF THE INVENTION

According to one aspect of the invention, there is at least provided a foldable step for installing within a cupboard comprising: an upper cross member and a lower cross member coupled in a horizontal orientation to the cupboard. A right side and a left side each comprise: a cupboard support member aligned vertically with the cupboard and coupled to the upper and lower cross members; at least two offset members pivotally coupled at one end to the cupboard support member; the offset members pivotally coupled at the other end to a vertical support member; an upper step support member pivotally coupled at one end to the top of the vertical support member; a lower step support member, being longer than the upper step support member, pivotally coupled near a midway along the vertical support member; an inter-step support member pivotally coupled at one end to the end of the upper step support and pivotally coupled at the other end to a point along the length of the lower step support member; an angled support member pivotally coupled at one end to the end of the upper step support and slidably coupled along the angled support member to the lower step support member between the point along the length of the lower step support and the end of the lower step support; an upper step coupled between the upper step support members of the right and left sides; and a lower step coupled between the lower step support members of the right and left sides. An upper offset member and a lower offset member may be selected from the at least two offset members where the lower offset member comprises a notch in the lower offset member that generally aligns with one of the joints between the other support members. The vertical support member may also comprise one or more notches that align with the joints of the other support members. The upper cross member and lower cross member may be coupled to the cupboard door by way of one or more brackets.

According to another aspect of the invention, there is at least provided a method of folding and unfolding a foldable step by rotating and sliding the joints according to the structure described herein.

BRIEF DESCRIPTION OF THE DRAWINGS

An embodiment will now be described, by way of example only, with reference to the attached Figures, wherein.

DETAILED DESCRIPTION OF THE EMBODIMENT

While the Background of Invention described above has identified particular problems known in the prior art, the present invention provides at least, in part, a new and useful application for an improved hidden foldable step.

Figure 1:
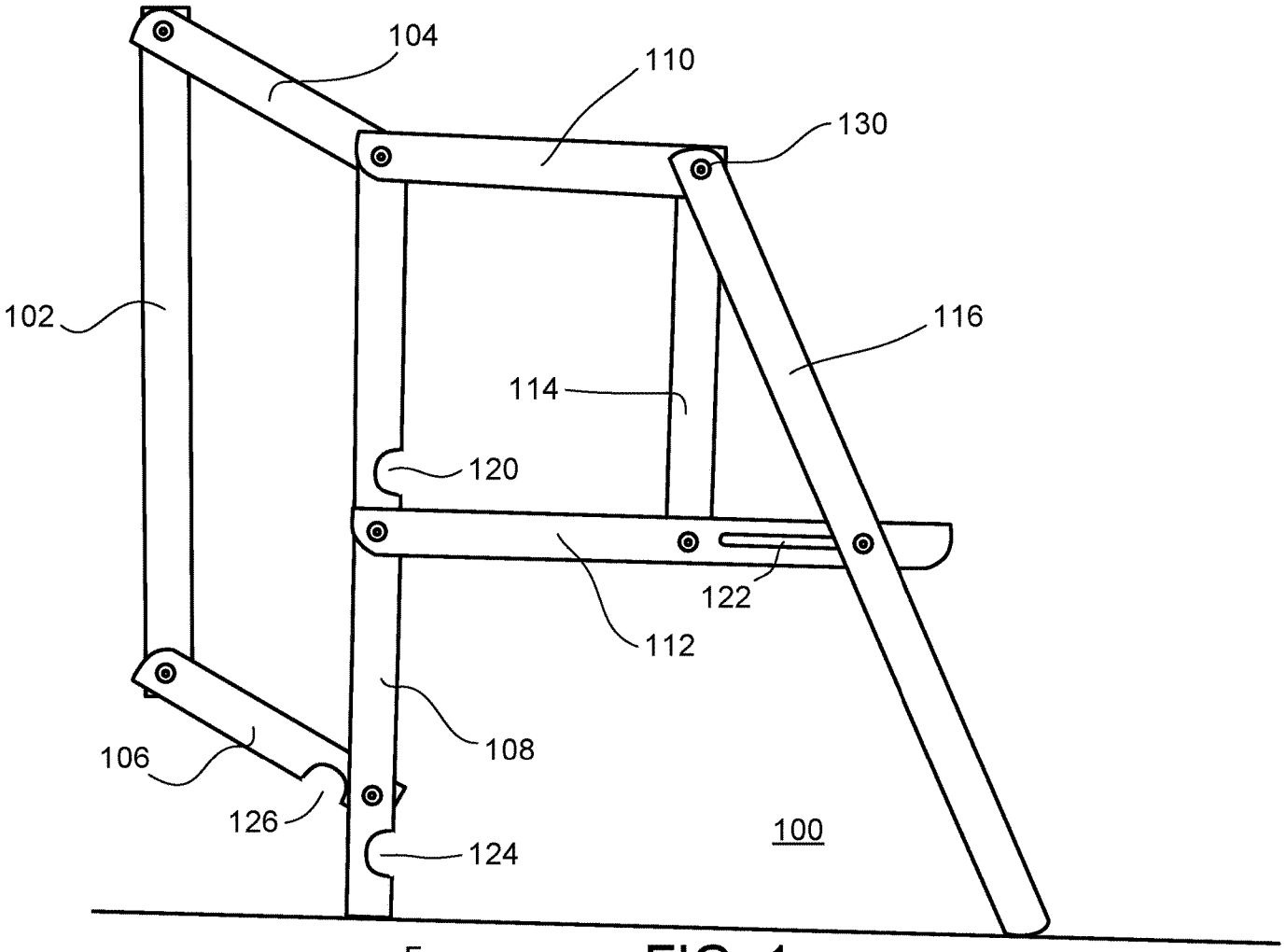
FIG. 1 shows a side view of a foldable step in an in-use configuration.
Figure 3:
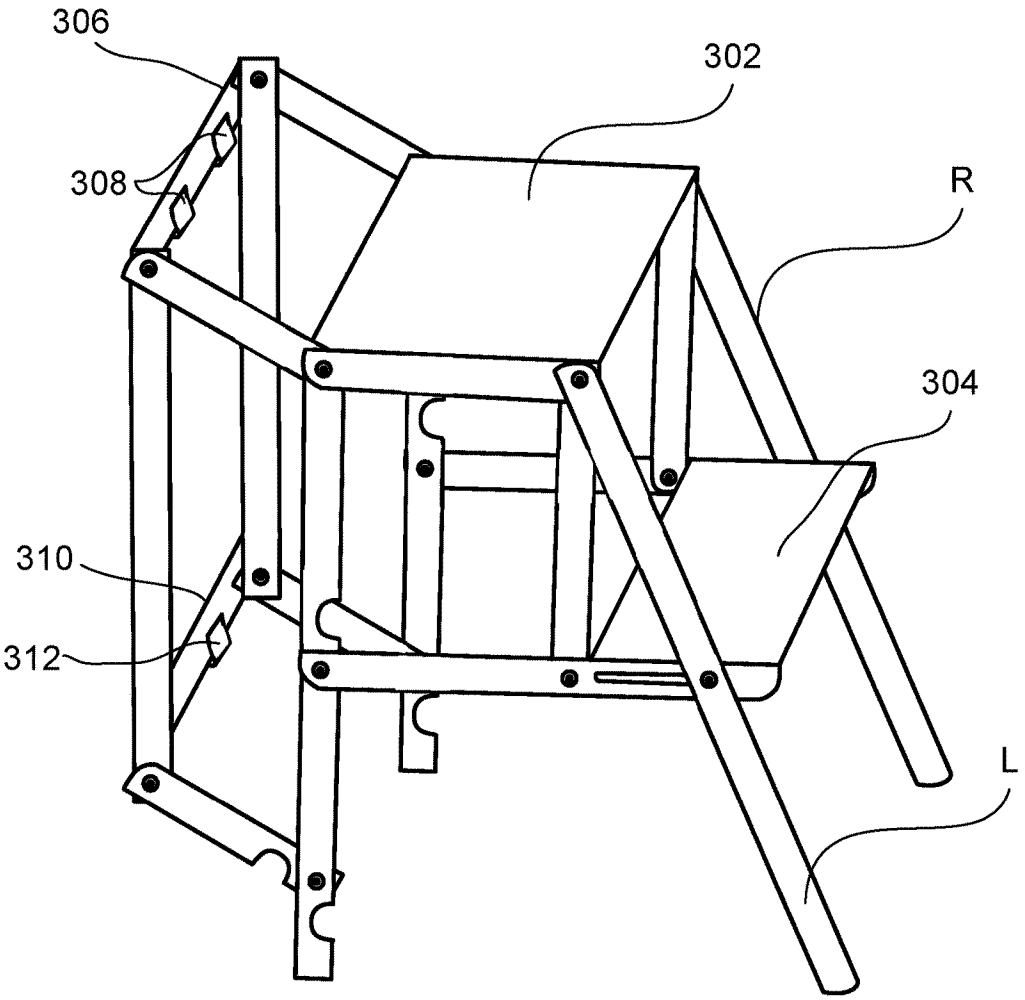
FIG. 3 shows an perspective view of the foldable step in an in-use configuration.

FIGS. 1 and 3 shows a foldable step 100 in an in-use configuration. The foldable step 100 is generally formed using a plurality of structural supports (102, 104, 106, 108, 110, 112, 114, 116) pivotally or rotatably coupled to one another using a plurality of pins 130 or other rotatable fastener such as rivets, nuts and bolts, pins, etc. Some of the structural supports are also coupled to each other by way of a sliding arrangement. The foldable step 100 has a right side R and a left side L that may be mirror images of each other. Alternatively, the two sides may be the same thereby reducing manufacturing costs. The right side R and left sides L are coupled together by at least one step 302 and preferably by two steps 302 and 304 (an upper step 302 and a lower step 304). The two steps 302 and 304 are generally planar pieces of wood, plastic, metal, or composite materials and may have a roughened stepping surface to prevent a person from slipping. Alternatively, the roughened surface may be provided by way of an adhesive tape.

In addition, the right side R and left side L may be coupled together at the back of each side by an upper cross member 306 and a lower cross member 310. The cross members 306, 310 are fastened to a cupboard support member 102 aligned with the cupboard door (not shown). The upper cross member 306 may be coupled to the cupboard door by one or more brackets 308. The brackets 308 may be secured to the cupboard door by gluing or with screws. The lower cross member 310 may be held to the cupboard door using a clip or bracket 312. During installation, the bracket 312 is installed at an appropriate height for the foldable step 100. The lower cross member 310 is then placed into the bracket 312 allowing the installer to more easily mark to position of the top brackets 308 or alternatively the installer may screw or fasten the upper cross member 306 using the top brackets 308 without marking the position.

For the left side L, the cupboard support member 102 is pivotally coupled to two offset members 104 and 106 that enable a vertical support member 108 to contact the floor F situated outside of the cupboard. These offset members 104 and 106 are of sufficient length as to enable the foldable step 100 to be installed into cupboard of varying heights. The lower offset member 106 further comprises a notch 126 that, during folding of the foldable step 100, aligns with one or more pins 130 allowing for complete folding of the foldable step 100 into a profile approximately the width of one of the support members.

In this embodiment, the vertical support member 108 is pivotally coupled to an upper step support member 110 and a lower step support member 112. The step members 110, 112 are generally horizontal when the foldable step 100 is in an in-use configuration. The vertical support member 110 comprises at least two notches 120 and 124 similar to the notch 126 as previously described. These two notches 120 and 124 align with one or more pins 130 during folding in order to minimize the profile.

The upper step support member 110 is preferably coupled at one end to the vertical support member 108 at an top end being the opposite a floor end in contact with the floor F. The upper step support member 108 is pivotally coupled at the other end to one end of an angled support member 116 and one end of an inter-step support member 114. During use, the angled support member 116 extends downward from the upper step support member 108 at an angle of between 20 and 40-degrees from vertical.

The lower step support member 112 is pivotally coupled at one end approximately midway between the floor end and the top end of the vertical support 108, but the coupling point is determined by the desired step height (e.g. a 7-inch rise and 11-inch run). The inter-step support member 114 extends downward from the upper step support member 108 in a generally vertical direction and is pivotally coupled to the lower step support member 112 approximately 60% of the length from the end coupled to the vertical support member 108. The angled support member 116 is slideably coupled to the lower step support member 112 by way of a slot 122. The slot 122 comprises approximately 24 percent of the length of the lower step support member 112, but may be other lengths depending on the configuration of the foldable step 100. When completely folded outward in the in-use configuration, each side L and R is supported by the vertical support member 108 and the angled support member 116 contacting the floor F. Also, the retainer of the angled support member 116 is at an end within the slot 122 furthest from the cupboard.

Figure 2:
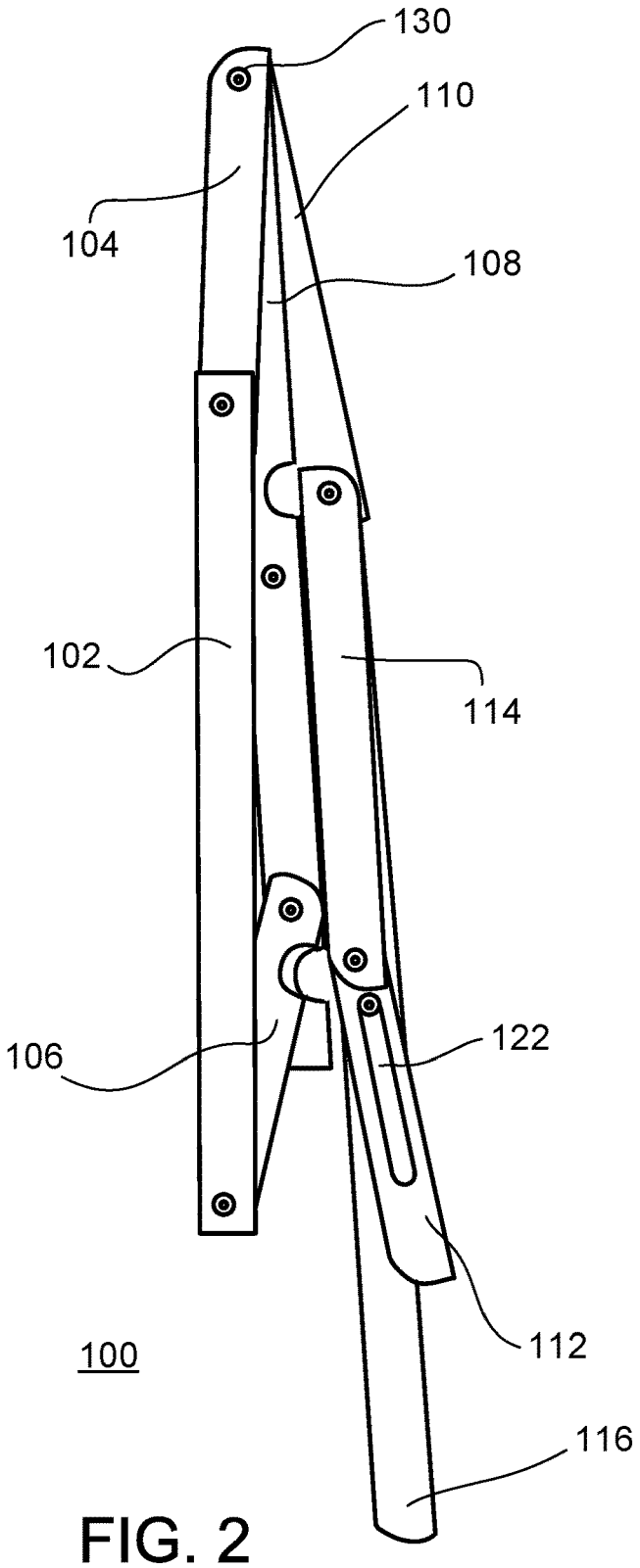
FIG. 2 shows a side view of the foldable step in a partially folded configuration.

Turning now to FIG. 2, the foldable step 100 is presented in a partially folded state. As can be more clearly observed, the notches 120, 124, and 126 are generally aligned with corresponding pins 130 at the connection points of the other members. The retainer of the angled support member 116 is now at the opposite end within the slot 122.

Although the description above describes the left side L, the description equally applies to the right hand side R.

Although the structural supports 102, 104, 106, 108, 110, 112, 114, 116 are depicted herein with a particular width, other embodiments may vary the width in order to carry the intended load and provide necessary structural stability for various sizes of people. The structural supports may be solid rectangular shapes but could also be tubular. Other embodiments may have structural supports 102, 104, 106, 114 being more narrow than structural supports 110, 112, 116, and 124.

Although particular dimensions of the structural supports are depicted herein, other embodiments may have longer or shorter dimensions without departing from the scope of the invention.

A number of implementations have been described. Nevertheless, it will be understood that various modifications may be made without departing from the scope of the invention as defined by the claims.

The above-described embodiments are intended to be examples of the present invention and alterations and modifications may be effected thereto, by those of skill in the art, without departing from the scope of the invention, which is defined solely by the claims appended hereto.

What is claimed is:

1. A foldable step for installing within a cupboard comprising:

an upper cross member and a lower cross member coupled in a horizontal orientation to the cupboard;

a right side and a left side, each side comprising:

a cupboard support member aligned vertically with the cupboard and coupled to the upper and lower cross members;

at least two offset members pivotally coupled at one end to the cupboard support member; the offset members pivotally coupled at the other end to a vertical support member;

an upper step support member pivotally coupled at one end to the top of the vertical support member;

a lower step support member, being longer than the upper step support member, pivotally coupled near a midway along the vertical support member;

an inter-step support member pivotally coupled at one end to another end of the upper step support and pivotally coupled at another end to a point along the length of a lower step support member;

an angled support member pivotally coupled at one end to the another end of the upper step support and slidably coupled along the lower step support member between the point along the length of the lower step support and an end of the lower step support distal from the vertical support member support;

an upper step coupled between the upper step support members of the right and left sides; and a lower step coupled between the lower step support members of the right and left sides.

2. The foldable step according to claim 1, wherein an upper offset member and a lower offset member are selected from the at least two offset members.

3. The foldable step according to claim 2, further comprising a notch in the lower offset member.

4. The foldable step according to claim 1, further comprising at least one notch in the vertical support member.

5. The foldable step according to claim 1, further comprising at least one bracket for coupling the upper cross member and lower cross member to the cupboard.

* * * * *